US008431808B2

(12) United States Patent
Nakata et al.

(10) Patent No.: US 8,431,808 B2
(45) Date of Patent: Apr. 30, 2013

(54) DRUM HOLDING STRUCTURE AND DRUM HELD BY THE HOLDING STRUCTURE

(75) Inventors: Eizo Nakata, Osaka (JP); Manabu Morioka, Osaka (JP); Takashi Wariishi, Osaka (JP); Shunsaku Tsuji, Osaka (JP)

(73) Assignee: Sakae Rhythm Musical Instrument Ltd., Osaka-shi (JP)

( * ) Notice: Subject to any disclaimer, the term of this patent is extended or adjusted under 35 U.S.C. 154(b) by 0 days.

(21) Appl. No.: 12/836,798

(22) Filed: Jul. 15, 2010

(65) Prior Publication Data

US 2011/0030531 A1 Feb. 10, 2011

(30) Foreign Application Priority Data

Jul. 15, 2009 (JP) ..... 2009-167282

(51) Int. Cl.
*G10D 13/02* (2006.01)

(52) U.S. Cl.
USPC ..... 84/421

(58) Field of Classification Search ..... 84/411 R, 84/421
See application file for complete search history.

(56) References Cited

U.S. PATENT DOCUMENTS

| | | | | |
|---|---|---|---|---|
| 3,186,289 | A * | 6/1965 | Kester, Jr. | 84/411 R |
| 5,309,811 | A * | 5/1994 | Hoshino | 84/421 |
| 2003/0192423 | A1 * | 10/2003 | Crouch | 84/421 |

FOREIGN PATENT DOCUMENTS

| | | |
|---|---|---|
| JP | 03-111895 | 5/1991 |
| JP | 05-127669 | 5/1993 |
| JP | 07-210154 | 8/1995 |

* cited by examiner

*Primary Examiner* — Kimberly Lockett
(74) *Attorney, Agent, or Firm* — Kratz, Quintos & Hanson, LLP

(57) ABSTRACT

To provide a drum holding structure that does not impair the resonance feature or the sound quality that the drum originally possesses, that is free of occurrence of strains or twists in the drum constituents despite a long term of use, and that is excellent in terms of workability, and a drum held by the holding structure.

A holding structure for fixing a drum 1 to a drum holding rod 9, in which an elongated plate-like holder member 3 extending circumferentially is held by, out of a plurality of bottom-side lugs 2 and 2A arranged on the bottom side of the drum 1, at least two successive prescribed bottom-side lugs 2A arranged circumferentially. The holder member 3 is provided with a bracket member 4 for the drum holding rod 9 to thereby hold the drum 1.

17 Claims, 5 Drawing Sheets

DRUM HOLDING STRUCTURE AND DRUM HELD BY THE HOLDING STRUCTURE

TECHNICAL FIELD

The present invention relates to a drum holding structure that is capable of stably holding a drum without impairing the sound effect of the drum and that is particularly suitable for holding a tom-tom, and a drum held by the holding structure.

BACKGROUND ART

What have conventionally been provided as drum holding structures of this kind are the ones in which a bracket is attached to the center portion of a drum shell, through which a drum holding rod extending from a tom-holder fixed to a bass drum is passed, to thereby hold the drum. However, in such a holding structure, the bracket being a foreign material is attached to the drum shell that should originally have an excellent sound resonance feature and is coupled to the drum holding rod. Therefore, the sound transfer is leaked through the bracket; the resonance feature is impaired; and the range is narrowed, whereby the sustaining sound and the attack feel when the sound is just produced cannot fully be obtained, which would otherwise be exhibited originally by the drum. Further, because the full weight of the drum is concentrated to the bracket portion of the drum shell, a long term of use results in occurrence of strains or twists locally at such portion of the drum shell, which may possibly impair the resonance feature even worse.

In order to cope with the problem, as a structure to avoid direct mounting of the bracket to the drum shell, there has been proposed a structure in which a drum holding-purpose member is mounted to a hoop at a drum shell opening end portion, or to a tightening adjustment bolt coupling the hoop to a lug, which is then fixed to the drum holding rod through a bracket (for example, see Patent Documents 1 to 3). However, when holding is carried out by mounting any holding-purpose member to bottom-side components such as the hoop or the tightening adjustment bolt, the force is exerted particularly on the bottom-side hoop in the direction to cause the bottom-side hoop to curl up by the drum's own weight. Therefore, when employing such a structure, use of the top-side hoop or the tightening adjustment bolt becomes inevitable. However, when the top side of the drum is held by the holding-purpose member or the bracket in this manner, the sound transfer from the top-side drumhead to the drum shell is hindered. This invites the problems similarly to the described above more significantly, i.e., impairment of the resonance feature that the drum shell originally possesses, the narrowed range and the like.

Further, each hoop is a retainer member for holding the head frame of the drumhead to set up the drumhead across the drum shell opening end portion, and the tightening adjustment bolt is an element for coupling the hoop to each lug to adjust the tension condition of the drumhead. They are each a delicate member that is directly related to the tension condition of the drumhead, that is, the sound quality. It is preferable to avoid as much as possible mounting any holding-purpose member to these hoop and the tightening adjustment bolt to suffer the drum's own weight. If such a drum's own weight results in strains or the like, it may invite uneven tension condition of the drumhead. Then, the original sound of the drum that the player expects cannot stably be produced. Furthermore, it poses another problem of workability, that the top-side drumhead cannot be replaced unless the drum is unloaded from the holder.

CITATION LIST

Patent Literature

Patent Document 1 JP-A No. 7-210154
Patent Document 2 JP-A No. 5-127669
Patent Document 3 JP-A No. 3-111895

SUMMARY OF INVENTION

Technical Problem

Accordingly, taking into consideration of the situation described in the foregoing, the present invention has been made to solve the problems by providing a drum holding structure that does not impair the resonance feature or the sound quality that the drum originally possesses, that is free of occurrence of strains or twists in the drum constituents despite a long term of use, and that is excellent in terms of workability, and a drum held by the holding structure.

Solution to Problem

In order to solve the problems described above, the present invention provides a drum holding structure for fixing a drum to a drum holding rod, in which an elongated plate-like holder member extending circumferentially is held by, out of a plurality of bottom-side lugs arranged on the bottom side of the drum, at least two successive prescribed bottom-side lugs arranged. The holder member is provided with a bracket member for the drum holding rod to thereby hold the drum.

Here, it is preferable to structure such that the prescribed bottom-side lugs are each provided with clamp means for holding the holder member in a clamped state, and the bracket member is provided at a prescribed position between the lugs at the holder member.

Further, it is preferable to structure such that the holder member is mounted to the prescribed bottom-side lugs having an elastic member interposed therebetween.

Still further, it is preferable to structure such that the prescribed bottom-side lugs are each structured with a lug body having a recess portion on its external surface side receiving the holder member together with the elastic member and a cover element being screwed to the lug body to cover the recess portion, and the holder member and the elastic member are clamped between the recess portion and the cover element.

Still further, the present invention provides a drum including the prescribed bottom-side lugs, the drum being fixed to a drum holding rod by the above-described drum holding structure using the holder member and the bracket member.

Advantageous Effects of Invention

The drum holding structure according to the present invention structured as in the foregoing has a structure in which an elongated plate-like holder member extending circumferentially is held by at least two successive prescribed bottom-side lugs arranged on the bottom side of the drum. The holder member is provided with a bracket member for the drum holding rod to thereby hold the drum. Accordingly, because the drum is held by using the originally arranged lugs, the resonance feature and the sound quality that the drum originally possesses are not impaired, and there is no adverse effect on the tension condition of the drumheads. Further, because the holder member is held by the two or more successive lugs on the bottom side, local concentration of the drum's own weight is avoided. Still further, because the drum is held by a plurality of lugs circumferentially arranged, the moment by the drum's own weight per portion corresponding to such a lug is suppressed to a small amount, whereby occurrence of any strains or twists on the drum shell can also be prevented.

Further, because the entire drum is held by the lugs on the bottom side, the portion of the drum shell on the upside (top side) relative to the lugs and the top-side drumhead is totally free of external restriction and kept intact. Thus, it becomes possible to allow the drum shell to exhibit its original resonance feature, and to allow the player to perform with an excellent sound quality that the drum originally possesses. Accordingly, as compared to the conventional drum held by the holding structure in which the bracket is provided to the drum shell, or mounted to the hoop or the tightening adjustment bolt, the widened range, the well sustained sound, and the improved attack feel when the sound is just produced are achieved. Even more, because the top side is similarly fully kept intact, the work such as replacement of the drumhead can easily be carried out while being kept in the held state. Thus, an excellent workability is maintained.

Still further, because the prescribed bottom-side lugs are each provided with clamp means for holding the holder member in a clamped state, and the bracket member is provided at a prescribed position between the lugs at the holder member, the attachment and removal between the bottom-side lugs and the holder member are also facilitated.

Still further, because the holder member is mounted to the prescribed bottom-side lugs having an elastic member interposed therebetween, it becomes possible to avoid leakage of the sound or transfer of the vibration from the bottom-side lugs to the holder member. Thus, it becomes possible to allow the drum to exhibit its original excellent sound quality.

Still further, because the prescribed bottom-side lugs are each structured with a lug body having a recess portion on its external surface side receiving the holder member together with the elastic member, and a cover element being screwed to the lug body to cover the recess portion, and the holder member and the elastic member are clamped between the recess portion and the cover element, the attachment and removal work is further facilitated, and the holder member can be held in a stabilized attitude with respect to the lugs.

DESCRIPTION OF EMBODIMENTS

Next, an embodiment of the present invention will be described in detail with reference to the accompanying drawings.

Figure 1:
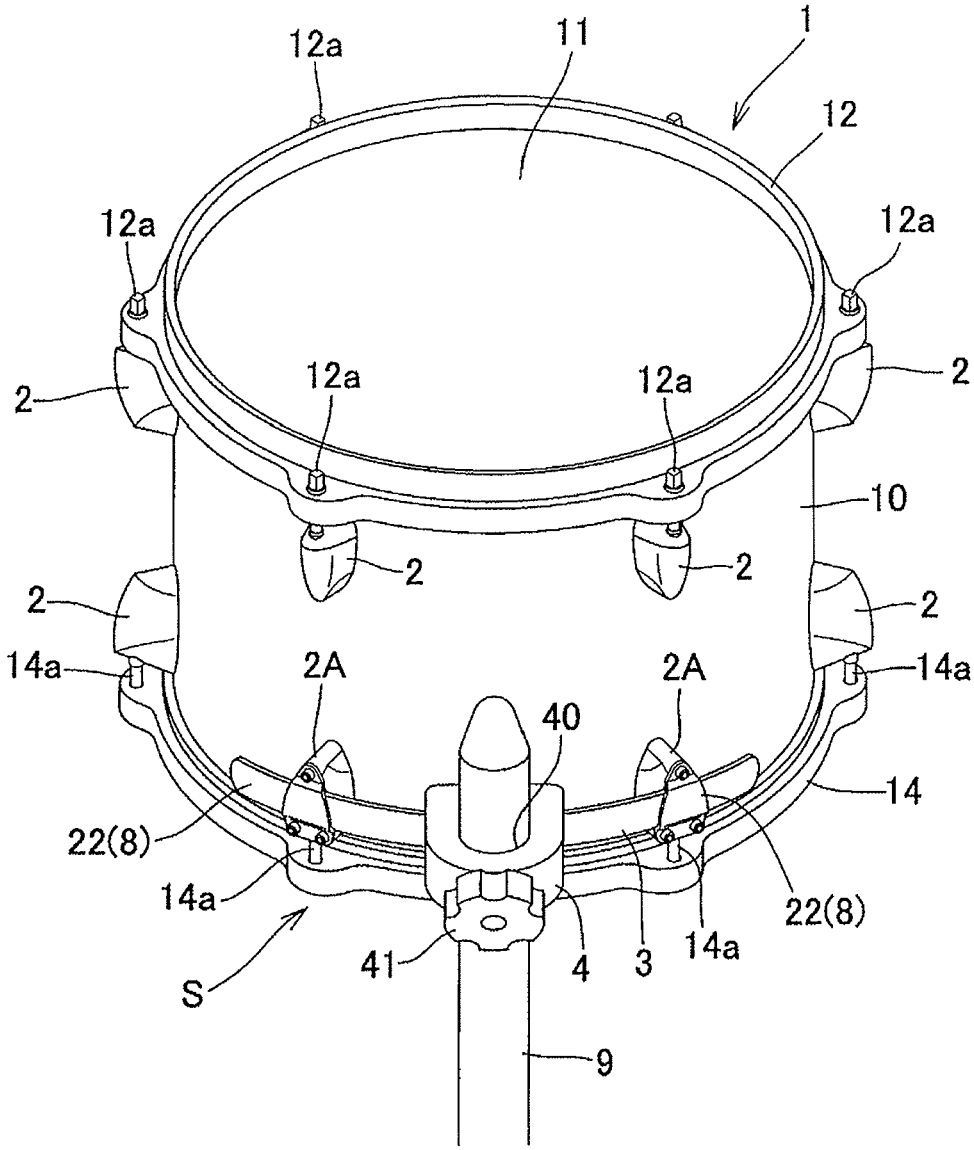
FIG. 1 is a perspective view showing a drum holding structure according to a representative embodiment of the present invention.

FIG. 1 is an explanatory drawing showing the structure of a drum holding structure according to the present invention. FIGS. 1 to 4 show a representative embodiment, and FIG. 5 shows a variation thereof. In the drawings, the reference character 1 denotes a drum, 2 and 2A denote lugs, 3 denotes a holder member, 4 denotes a bracket member, 9 denotes a drum holding rod, and S denotes a holding structure.

As shown in FIG. 1, a drum holding structure S of the present invention is a holding structure for fixing a drum 1 to a drum holding rod 9. It has a structure in which an elongated plate-like holder member 3 extending circumferentially is held by at least two prescribed bottom-side lugs 2A successively arranged circumferentially out of a plurality of bottom-side lugs 2 and 2A arranged on the bottom side of the drum 1, which holder member 3 is provided with a bracket member 4 for the drum holding rod 9 to hold the drum 1. Though the holder member 3 and the bracket member 4 are made of metal, other materials may be used so long as adequate strength can be maintained. The most suitable drum to be held by the holding structure of the present invention is a medium size drum called a tom-tom.

With a conventional holding structure, the holder is fixed to the hoop or the tightening adjustment bolt that are located near to the top-side drumhead beaten by the player, or the bracket is directly fixed to the drum shell to hold the drum. Therefore, transfer of a sound produced from the top-side drumhead is leaked to the holder or the bracket and thus impaired, and the resonance feature that the drum shell originally possesses cannot fully be exhibited. On the other hand, in the present invention, the holder is held at the position on the bottom side distanced away from the beaten top-side drumhead, and even more, the holder is held by a plurality of bottom-side lugs that are originally fixed to the drum shell. Thus, at least the portion of the drum shell higher than that part (on the top side) is kept intact, and the inherent resonance feature is not impaired at all. Thus, it becomes possible to obtain an excellent sound quality.

The drum holding rod 9 is a holding member being a tip extending from a conventionally known tom-holder, for example. The bottom end portion of the tom-holder is fixed to a bass drum through a not-shown tom-holder base, or it is fixed to a floor standing type stand. It is noted that conventionally known elements can be employed for the structures other than the structure of the lugs 2A of the drum 1. As to the mode of the drum holding rod 9 also, while the present embodiment shows the drum holding rod 9 extending vertically, the present invention is not particularly limited thereto, and the drum holding rod 9 may extend horizontally so as to be perpendicular to the drum shell. Thus, by employing the fixing structure in which the bracket member 4 is modified to conform to the drum holding rod in any of various modes, the present invention can be applied to any conventionally known drum holding rod in any of various modes.

Figure 2:
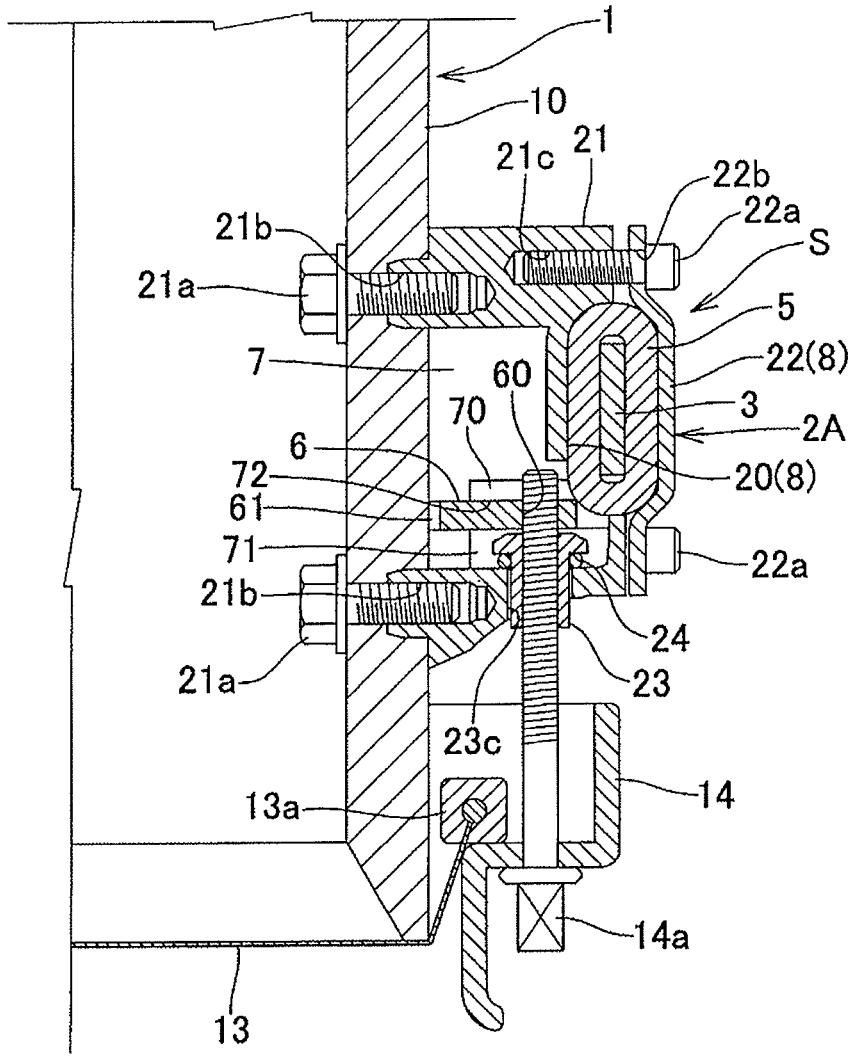
FIG. 2 is a cross-sectional view showing a substantial part of the drum holding structure according to the representative embodiment of the present invention.

As shown in FIGS. 1 and 2, the drum 1 (medium size drum) is structured with constituents such as: drumheads 11 and 13 that are respectively arranged at opening end portions at the upside and the downside of the drum shell 10 (the top side and the bottom side thereof); annular head frames 13*a* that hold the outer circumference portions of the drumheads 11 and 13 and that fit to the outer circumferences of the opening end portions of the drum shell 10; top-side and bottom-side hoops 12 and 14 that similarly fit to the outer circumferences of the opening end portions of the drum shell 10; a plurality of lugs 2 and 2A that are circumferentially arranged at intervals respectively on the top side outer circumference and on the bottom side outer circumference of the drum shell 10 respectively; and tightening adjustment bolts 12*a* and 14*a* that couple the hoops 12 and 14 to the lugs 2 and 2A.

The tightening adjustment bolts 12*a* and 14*a* are for variably setting the tension of the drumheads 11 (13). The tightening adjustment bolts 12*a* and 14*a* penetrate through mounting holes of the hoops 12 (14) and are screwed with lug nuts 23 assembled in the lugs 2 and 2A. When the tightening adjustment bolts 12*a* (14*a*) are tightened to press the hoops 12 (14) against the head frames, the head frames respectively shift toward the lugs 2 and 2A side, whereby the drumheads 11 (13) are radially stretched to be increased in tension, and the sound of the drum is adjusted.

As shown in FIG. 2, the lugs 2 and 2A are fixed to the external surface of the drum shell 10 by mounting screws 21*a* that penetrate through the drum shell 10 from the inside to screw with threaded holes 21*b*. On the hoop 14 (12) sides of the lugs 2 and 2A, mounting holes 23*c* to which the lug nuts 23 are loosely fit from an interior space 7 side are provided, wherein the lug nuts 23 are screwed with the tightening adjustment bolts 14*a* (12*a*) extending from the hoops. Each head portion of the lug nuts 23 attains detent by engaging with a pair of abutment faces 71 of an interior wall portion 70 exposed to the interior space 7, whereby each lug nut 23 is allowed to screw with each tightening adjustment bolt 14*a*. The reason why the lug nuts 23 are loosely fit to the mounting holes 23*c* is that the tightening adjustment bolts 14*a* integrated with the lug nuts 23 permit a small amount of tilt to the lugs 2 and 2A. A rubber ring 24 is interposed between the head portion of each lug nut 23 and the edge portion inside each mounting hole 23*c*, so as to avoid unnecessary play to prevent occurrence of noises.

Figure 3:
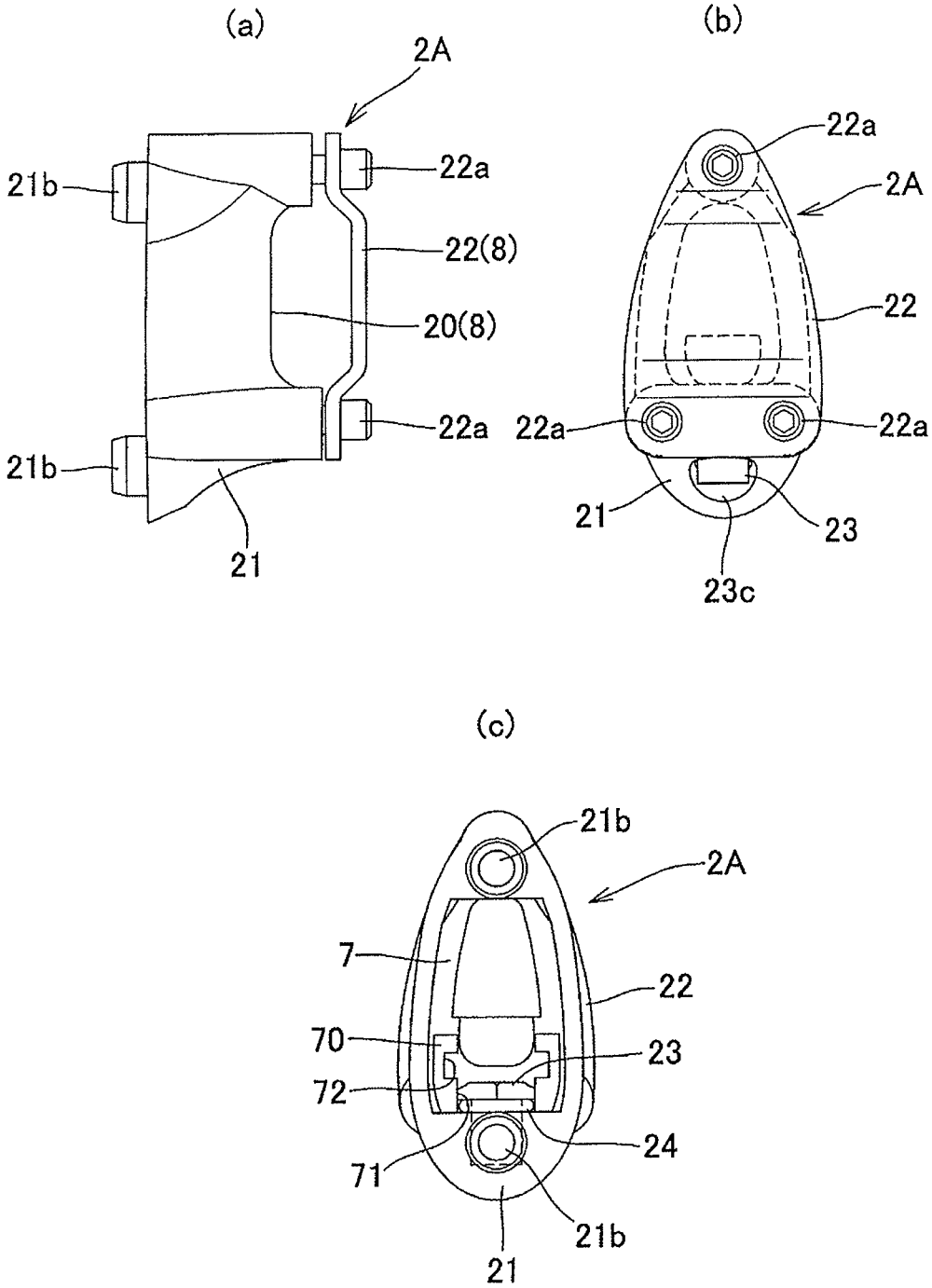
FIG. 3 is an explanatory drawing showing a lug used for the drum holding structure according to the representative embodiment of the present invention, in which (a) is a side view, (b) is an elevational view, and (c) is a bottom view.
Figure 4:
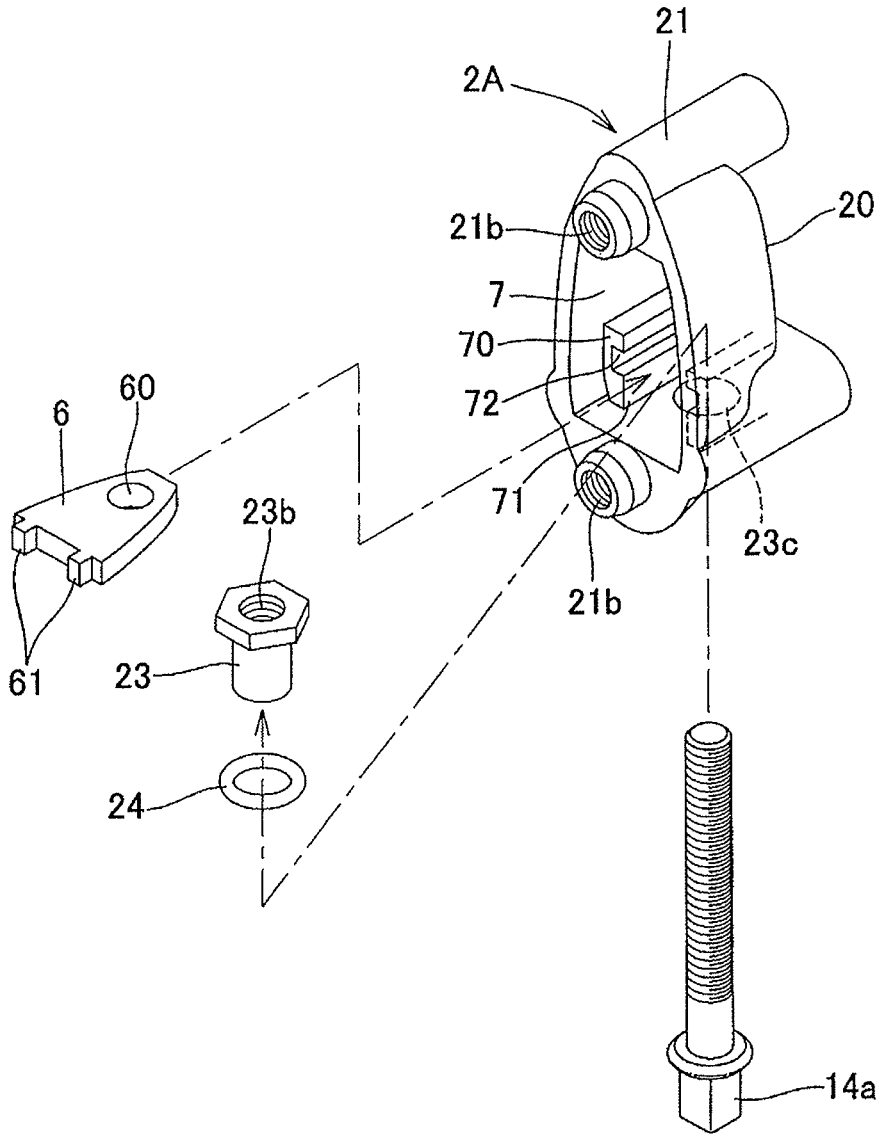
FIG. 4 is an exploded perspective view of the lug according to the representative embodiment of the present invention.
Figure 5:
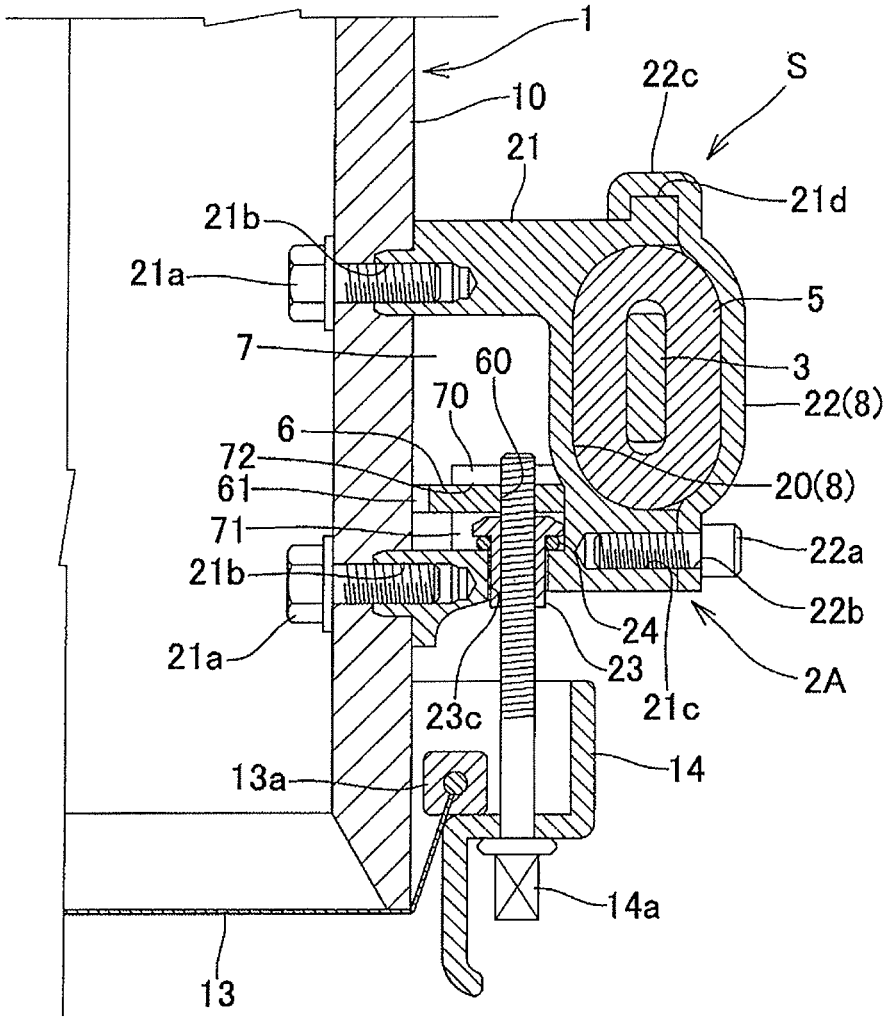
FIG. 5 is a cross-sectional view showing a substantial part of a drum holding structure according to a variation of the present invention.

Further, as also shown in FIGS. 3 and 4, a stopper plate 6 for preventing each lug nut 23 from coming off on the interior space 7 side is engaged with a pair of engagement grooves 72 similarly formed on the interior wall portion 70 of the lugs 2 and 2A. Formed on the stopper plate 6 is a through hole 60 through which the tip side of the tightening adjustment bolt 14*a* having passed through the lug nut 23 passes. Also formed on the stopper plate 6 are projection portions 61 that adhere by pressure to the front surface of the drum shell 10 when each of the lugs 2 and 2A is fixed to the drum shell 10, so as to avoid unnecessary play of the stopper plate 6 to prevent occurrence of noises.

FIGS. 3 and 4 show the structure of a prescribed lug 2A for holding the holder member 3. It is to be noted that the structure of the lug 2A described in the foregoing is in common with the other lug 2. The structure specific to the lug 2A is that, as shown in FIGS. 2 to 4, the lug 2A is made up of split components, one of the split components being a lug body 21 that has a recess portion 20 for receiving the holder member 3 together with an elastic member 5 on the external surface side, and the other being a cover element 22 screwed to the lug body 21 so as to cover the recess portion 20. The recess portion 20 and the cover element 22 function as clamp means 8 for clamping the holder member 3 and the elastic member 5 between them. It is preferable that the lug body 21 and the cover element 22 are made of the same material as the other lug 2, and in the present embodiment, they are made of metal.

More specifically, it is structured such that, by causing mounting screws 22*a* to penetrate through through holes 22*b* located at top and bottom appropriate positions on the cover element 22, and then screwing the mounting screws 22*a* with threaded holes 21*c* provided at corresponding positions on the external surface of the recess portion 20 of the lug body 21, the holder member 3 and the elastic member 5 interposed between the recess portion 20 and the cover element 22 are clamped and fixed. It is noted that, as shown in FIG. 5, it is also possible to provide a hook piece 22*c* to be hooked on the lug body 21 at one portion of the cover element 22 (in the illustrated example, the top end portion), such that the other portion (the bottom end portion) is fixed by the mounting screw 22*a*. This makes it possible to carry out the mounting work of the holder member 3 and the elastic member 5 to the lugs 2A in a more efficient manner. Even more, a reduction in the number of mounting screws contributes toward an improved appearance.

In the present embodiment, the description proceeds taking up an exemplary case in which the clamp means 8 is structured as means for causing the holder member 3 to be held by the lugs 2A. However, in place of such clamp means 8, it is possible to provide a through hole at the position in the holder member 3 corresponding to each of the lugs 2A, so as to directly fix the holder member 3 to the lugs 2A using a mounting screw penetrating through the through hole. Further, while the split components structuring each lug 2A, namely the lug body 21 and the cover element 22, are coupled to each other using the mounting screws 22*a*, other structure for engaging them to each other by use of any other engagement means can naturally be employed. Still further, a structure in which the holder member 3 and the prescribed lug 2A are integrally formed, in particular, in which the holder member 3 and the cover element 22 are integrally formed, is also a preferable embodiment.

As shown in FIGS. 1 and 2, the holder member 3 is an elongated metal plate formed in a curved shape surrounding the outer circumference of the drum shell 10. In the present embodiment, the holder member 3 is set to just long enough to be held by at least two lugs 2A. The length of the holder member 3, the number of lugs 2A holding the holder member 3 and the like are determined as appropriate by the size, weight and the like of the drum 1 to be held. For example, it is also possible to set the length thereof to a length half as long as the outer circumference of the drum shell 10 or longer than that. In particular, the holder member 3 may be formed as long as the entire circumference of the drum shell 10, in a ring-like manner.

The elastic member 5 is a member being hard or soft synthetic rubber or foam material, which is partially attached to a portion in the holder member 3 held by each lug 2A, that functions to absorb or block the vibration with the elastic deformation so as to prevent the transfer of the vibration to the holder side from the lug 2A that receives the vibration of the drum shell 10. In the present embodiment, the elastic member 5 is structured cylindrically and previously covered over the site of the holder member 3 where it is held by each lug 2A. However, it may be formed in an inverted-C shape and similarly covered over the site. Alternatively, a sheet-like member attached to each of internal and external surfaces attached to the holder member 3 by adhesion or the like may be interposed when the holder member 3 is held by the lugs 2A.

As shown in FIG. 1, the bracket member 4 is arranged around the center portion of the holder member 3 between the lugs 2A. The bracket member 4 is structured with holding hardware for holding the drum holding rod 9. The bracket member 4 has a holding hole 40 through which the drum holding rod 9 is passed through, and is provided with a fixing screw 41 for holding the passed through drum holding rod 9 at a desired height position. In the present embodiment, while the holding hardware is directly fixed to the holder member 3 by use of screws or welding, the holding hardware may be mounted through a metal plate or the like. Such a bracket member 4 can be integrally formed with the holder member 3 as a die casting product or the like, in place of the above-described manner in which it is fixed to the holder member 3 by welding or use of screws or the like. Further, the bracket member 4 may be mounted so as to be slidable in the circumferential direction (longitudinal direction) along the drum shell 10 relative to the holder member 3.

In the foregoing, the description has been given of the embodiment of the present invention. However, the present invention is not limited to the embodiment, and it goes without saying that the present invention can be practiced in various modes within a range not departing from the gist of the present invention.

REFERENCE SIGNS LIST

1 drum
2, 2A lug
3 holder member
4 bracket member
5 elastic member
6 stopper plate
7 interior space
8 clamp means
9 drum holding rod
10 drum shell
11 drumhead
12 hoop
12*a* tightening adjustment bolt
13 drumhead
13*a* head frame
14 hoop
14*a* tightening adjustment bolt
20 recess portion
21 lug body
21*a* mounting screw
21*b* threaded hole
21*c* threaded hole
22 cover element
22*a* mounting screw
22*b* through hole
22*c* hook piece
23 lug nut
23*c* mounting hole
24 rubber ring
40 holding hole
41 fixing screw
60 through hole
61 projection portion
70 interior wall portion
71 abutment face
72 engagement groove

The invention claimed is:

1. A drum holding structure for fixing a drum to a drum holding rod, comprising a plurality of bottom-side lugs fixed to the external surface of a drum shell of the drum and arranged circumferentially on a bottom-side of the drum, an elongated plate-like holder member extending circumferentially with respect to the drum shell and held by at least two successive prescribed bottom-side lugs, and a bracket member for engaging the holder member and the drum holding rod to thereby hold the drum.

2. A drum holding structure for fixing a drum to a drum holding rod, wherein an elongated plate-like holder member extending circumferentially is held by at least two successive prescribed bottom-side lugs arranged on a bottom side of the drum, the holder member is provided with a bracket member for the drum holding rod to thereby hold the drum, the prescribed bottom-side lugs are each provided with clamp means for holding said holder member in a clamped state, and the bracket member is provided at a prescribed position between the lugs at the holder member.

3. The drum holding structure according to claim 2, wherein the holder member is mounted to the prescribed bottom-side lugs having an elastic member interposed therebetween.

4. The drum holding structure according to claim 3, wherein the prescribed bottom-side lugs are each structured with a lug body having a recess portion on its external surface side receiving the holder member together with the elastic member, and a cover element being screwed to the lug body to cover the recess portion, and the holder member and the elastic member are clamped between the recess portion and the cover element.

5. A drum comprising the prescribed bottom-side lugs, wherein the drum is fixed to a drum holding rod by the drum holding structure according to claim 4, the drum holding structure using the holder member and the bracket member.

6. A drum holding structure for fixing a drum to a drum holding rod, wherein an elongated plate-like holder member extending circumferentially is held by at least two successive prescribed bottom-side lugs arranged on a bottom side of the drum, the holder member is provided with a bracket member for the drum holding rod to thereby hold the drum, and the holder member is mounted to the prescribed bottom-side lugs having an elastic member interposed therebetween.

7. The drum holding structure according to claim 6, wherein the prescribed bottom-side lugs are each structured with a lug body having a recess portion on its external surface side receiving the holder member together with the elastic member, and a cover element being screwed to the lug body to cover the recess portion, and the holder member and the elastic member are clamped between the recess portion and the cover element.

8. A drum comprising the prescribed bottom-side lugs, wherein the drum is fixed to a drum holding rod by the drum holding structure according to claim 7, the drum holding structure using the holder member and the bracket member.

9. A drum holding structure for fixing a drum to a drum holding rod, wherein an elongated plate-like holder member extending circumferentially is held by at least two successive prescribed bottom-side lugs arranged on a bottom side of the drum, the holder member is provided with a bracket member for the drum holding rod to thereby hold the drum, the prescribed bottom-side lugs are each structured with a lug body having a recess portion on its external surface side receiving the holder member together with an elastic member, and a cover element being screwed to the lug body to cover the recess portion, and the holder member and the elastic member are clamped between the recess portion and the cover element.

10. A drum comprising the prescribed bottom-side lugs, wherein the drum is fixed to a drum holding rod by the drum holding structure according to claim 9, the drum holding structure using the holder member and the bracket member.

11. The drum holding structure according to claim 2, wherein the prescribed bottom-side lugs are each structured with a lug body having a recess portion on its external surface side receiving the holder member together with the elastic member, and a cover element being screwed to the lug, body to cover the recess portion, and the holder member and the elastic member are clamped between the recess portion and the cover element.

12. A drum comprising the prescribed bottom-side lugs, wherein the drum is fixed to a drum holding rod by the drum holding structure according to claim 2, the drum holding structure using the holder member and the bracket member.

13. A drum comprising the prescribed bottom-side lugs, wherein the drum is fixed to a drum holding rod by the drum holding structure according to claim 1, the drum holding structure using the holder member and the bracket member.

14. A drum comprising the prescribed bottom-side lugs, wherein the drum is fixed to a drum holding rod by the drum holding structure according to claim 4, the drum holding structure using the holder member and the bracket member.

15. The drum holding structure according to claim 1, wherein the prescribed bottom-side lugs are each provided with clamp means for holding said holder member in a clamped state, and the bracket member is provided at a prescribed position between the lugs at the holder member.

16. The drum holding structure according to claim 1, wherein the holder member is mounted to the prescribed bottom-side lugs having an elastic member interposed therebetween.

17. The drum holding structure according to claim 1, wherein the prescribed bottom-side lugs are each structured with a lug body having a recess portion on its external surface side receiving the holder member together with the elastic member, and a cover element being screwed to the lug body to cover the recess portion, and the holder member and the elastic member are clamped between the recess portion and the cover element.

* * * * *